United States Patent [19]

Franklin

[11] 4,358,755

[45] Nov. 9, 1982

[54] SIGNAL SELECTION CIRCUIT

[75] Inventor: Cecil Franklin, Middleburg, Vt.

[73] Assignee: Simmonds Precision Products, Inc., Tarrytown, N.Y.

[21] Appl. No.: 241,895

[22] Filed: Mar. 9, 1981

[51] Int. Cl.[3] ..... G08B 26/00

[52] U.S. Cl. ..... 340/518; 340/511; 340/661

[58] Field of Search ..... 340/518, 511, 517, 506, 340/507, 650, 651, 661, 658, 519, 520

[56] References Cited

U.S. PATENT DOCUMENTS

| | | | |
|---|---|---|---|
| 3,124,752 | 3/1964 | Howard | 455/308 X |
| 3,158,849 | 11/1964 | Thaler | 340/517 X |
| 3,247,498 | 4/1966 | Sadvary et al. | 340/519 |
| 3,702,473 | 11/1972 | Fink | 340/650 |
| 3,761,907 | 9/1973 | Walsh | 340/520 |
| 3,829,850 | 8/1974 | Guetersloh | 340/511 X |
| 3,851,160 | 11/1974 | Heimprecht | 340/511 X |
| 3,872,457 | 3/1975 | Ray et al. | 340/518 |
| 3,882,492 | 5/1975 | McSorley et al. | 340/518 |
| 4,001,818 | 1/1977 | Radichel et al. | 340/520 |
| 4,152,656 | 5/1979 | Udvardi-Lakos | 340/661 X |

*Primary Examiner*—John W. Caldwell, Sr.
*Assistant Examiner*—Daniel Myer
*Attorney, Agent, or Firm*—Edwin E. Greigg

[57] ABSTRACT

A signal selection system, including a plurality of detection circuits having inputs receiving respective direct voltage signals and outputs connected to a scan bus. Each detector circuit includes an operational amplifier having a non-inverting input receiving one of the direct voltage signals, an inverting input connected to the scan bus, and an output connected via a diode to the scan bus, so that the scan bus is maintained at essentially the highest or lowest signal of the signals being scanned, depending on the orientation of the detector circuit diodes. The system includes a plurality of indicators, associated respectively with the detector circuit diodes, for indicating whenever the associated diode is forward-biased, and an alarm circuit connected to the scan bus for indicating whenever the scan bus voltage exceeds a maximum value if the signal being detected is the highest signal, or whenever the scan bus voltage is less than a minimum value if the signal being detected is the lowest signal. The operational amplifier outputs are connected through respective resistors to a first constant reference voltage, and the scan bus is connected through a load resistor to a second constant reference voltage, the resistors and reference voltages being selected so that, in the absence of an operational amplifier output signal, the associated diode will be forward-biased to allow sufficient current to flow through the load resistor to maintain the scan bus voltage at a value which causes the alarm circuit to indicate.

13 Claims, 5 Drawing Figures

SIGNAL SELECTION CIRCUIT

BACKGROUND OF THE INVENTION

This invention relates to an automatic scanning circuit for determining or selecting the highest or lowest of a plurality of signals representative of any of several parameters such as temperature, pressure, vibration, etc.

In known automatic scanning circuits, such as the circuit described in U.S. Pat. No. 3,124,752, issued Mar. 10, 1964 to S. Thaler, a diode matrix is utilized to select the highest or lowest of the plurality of signals being scanned. Similarly, in U.S. Pat. No. 3,158,849, issued Nov. 24, 1964 to S. Thaler, a transistor matrix is used to perform this signal selection function and also to energize an indicating light identifying the selected signal. In both of these prior known automatic scanning circuits, each signal being scanned must include a dc component which varies directly as an ac component of the same signal, so that the selected signal will not be attenuated by the inherent voltage drop across the conducting diode or transistor. However, in these known signals scanning circuits, slight differences in the forward voltage drops of the diodes or transistors affect the switch-over point between signals of similar magnitude.

OBJECTS AND SUMMARY OF THE INVENTION

Therefore, it is an object of the invention to provide an automatic signal scanning system, having input circuits which are connected to receive respective direct voltage sensor signals, for supplying the instantaneously highest or lowest direct voltage signal without attenuation, wherein the switch-over point between input signals of similar magnitude is very sharply defined.

It is another object of the invention to provide such a signal scanning system, which includes indicators associated with respective inlet circuits, for indicating the inlet circuit receiving the instantaneously highest or lowest sensor signal.

It is a still further object of the invention to provide an automatic signal scanning system of the type described above which includes indicators associated with respective inlet circuits for indicating and identifying any one of the connecting lines supplying respective sensor signals to the system input circuits, which is opened or grounded.

It is still another object of the invention to provide this signal scanning system with an alarm indicator circuit for indicating whenever one of the sensor signals exceeds a predetermined maximum value, or falls below a predetermined minimum value. It is a related object of the invention to provide such a signal scanning system, wherein the alarm indicator circuit also indicates an open or grounded connecting line for supplying one of the sensor signals.

The automatic signal scanning system described herein includes a plurality of priority detector circuits having first outputs connected to a scan bus, second outputs connected to respective indicating lamp drivers, and inputs connected to receive respective direct voltage sensor signals of the same polarity relative to ground which are variable within an operating voltage range between maximum and minimum operating voltage values.

As used herein, the maximum, or highest, signal of the direct voltage signals supplied to the signal scanning system is the most positive signal, and the minimum, or lowest, signal of these direct voltage signals is the most negative signal. When the voltage signal to be detected is the maximum voltage signal, the scan bus is connected through a resistor to a direct voltage source which is more negative than the minimum operating voltage of the direct voltage signals being scanned. When the voltage signal to be detected is the minimum voltage signal, the scan bus is connected through a resistor to a direct voltage source which is more positive than the maximum operating voltage of the direct voltage signals being scanned.

Each priority detector circuit includes an operational amplifier having a high voltage gain, in the order of several magnitudes. Each operational amplifier has an inverting input connected to the bus, a non-inverting input connected to receive one of the direct voltage signals being scanned, and an output which is also connected to the scan bus via a diode which is rendered conductive only when the limiting (maximum or minimum) direct voltage signal to be determined is supplied to the non-inverting input of the operational amplifier. The operational amplifier is thus arranged as a voltage follower so that when the diode conducts, the scan bus is maintained at essentially the same voltage level as that of the limiting signal supplied to the non-inverting input of the operational amplifier, and the diodes of the other priority detector circuits are reversed-biased.

When a first sensor signal supplied to a first priority detector circuit is the limiting signal being detected, and a change occurs in the sensor signals being scanned so that a second sensor signal supplied to a second priority detector circuit becomes the limiting signal, the second signal supplied to the non-inverting amplifier input of the second priority detector circuit will change in polarity relative to the scan bus voltage supplied to the inverting amplifier input. This, in turn, will cause the high voltage gain of this operational amplifier to be applied to the amplifier output, to abruptly switch the amplifier output voltage, relative to the scan bus voltage, from a voltage of a first polarity to a voltage of an opposite second polarity, to forward-bias the diode of the second priority detector circuit and allow sufficient current flow therethrough to maintain the scan bus voltage essentially equal to the second sensor signal.

When the scan bus voltage starts to change from the first sensor signal, the high voltage gain of the operational amplifier of the first priority detector circuit will be applied to the output of this amplifier, to abruptly switch the amplifier output voltage, relative to the scan bus voltage, from the second polarity voltage to the opposite first polarity voltage, to reverse-bias the diode of the first priority detector circuit and render it non-conductive.

The amplifier output voltage signal of each priority detector circuit is supplied to the associated lamp driver to switch this lamp driver to an ON state whenever the diode is conducting, and to an OFF state whenever the diode is reversed-biased.

The signal scanning system may also include an alarm detector circuit connected to the scan bus to provide indication either when the maximum signal being detected exceeds a predetermined value or the minimum signal being detected falls below a predetermined value, to thus indicate abnormally high or low values of the parameter, such as temperature or pressure, being monitored.

Also, the operational amplifier output of each priority circuit may be connected through a resistance to a constant direct voltage source which are selected so that the input to the priority detector circuit is either opened or grounded, the voltage which appears at the operational amplifier output is sufficient to cause the diode to conduct and the alarm detector circuit to provide indication of an abnormal condition.

The invention will be better understood as well as further objects and advantages thereof will become more apparent from the ensuing detail description of several preferred embodiments, taken in conjunction with the drawings.

DESCRIPTION OF PREFERRED EMBODIMENTS

Figure 1:
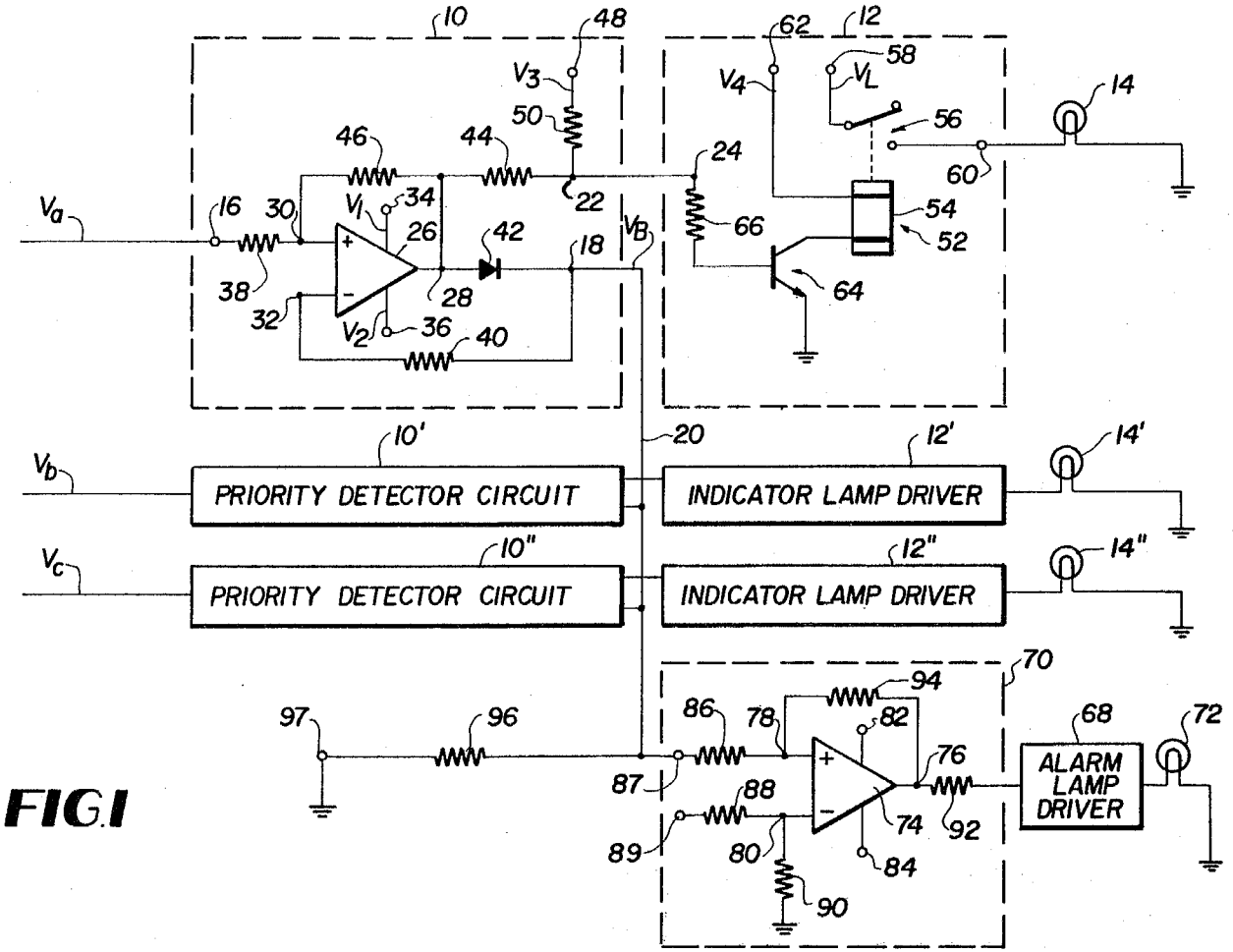
FIG. 1 is an electical schematic diagram, partially in block form, of a first embodiment of the invention for detecting the instantaneous maximum signal of a plurality of direct voltage signals.

FIG. 1 shows an automatic signal scanning system for determining the maximum signal of three positive polarity direct voltage signals $V_a$, $V_b$, $V_c$, which are variable between a minimum operating voltage value and a maximum operating voltage value. The signal scanning system includes three identical priority detectors circuits 10, 10', 10'', which are associated respectively with identical indicator lamp drivers 12, 12', 12'' and three indicator lamps 14, 14', 14''. The three priority detectors 10, 10', 10'' include input terminals 16 connected to receive the positive polarity signals $V_a$, $V_b$, $V_c$, respectively, first output terminals is connected to a scan bus 20, and second output terminals 22 connected to input terminals 24 of the indicator lamp drivers 12, 12', 12'' respectively.

Each priority detector circuit 10, 10', 10'' includes operational amplifier 26 having a high gain, in the order of several magnitudes. Each operational amplifier 26 has an output 28, a non-inverting input 30, an inverting input 32, a positive operating power terminal 34 and a negative operating power terminal 36. The positive and negative power terminals 34, 36 are connected to receive substantially constant positive and negative direct voltages $V_1$ and $V_2$ respectively, from a power supply source (not shown). One of the positive voltage signals $V_a$, $V_b$, or $V_c$ is applied to the non-inverting input 30 of the operational amplifier 26 through a first input resistor 38 connected between the non-inverting output 30 and the input terminal 16 of the priority circuit. The scan bus voltage $V_B$ is supplied to the non-inverting input 32 of the operational amplifier 26 through a second input resistor 40 which is connected between the non-inverting input 32 and the first output terminal 18. The operational amplifier output 28 is connected to the scan bus 20 by a diode 42 having an anode connected to the operational amplifier output 28 and a cathode connected to the first output terminal 18. The operational amplifier output 28 is also connected to the second output terminal 22 of the priority detector circuit by a resistor 44. A feedback resistor 46, connected between the operational amplifier output 28 and the non-inverting amplifier input 30, has an ohmic value which is larger by several orders of magnitude than the ohmic value of the input resistor 38, so that the voltage gain of the operational amplifier 26 is essentially the open-loop voltage gain of the amplifier 26.

The priority detector circuit also includes a second input terminal 48 which is connected to receive a substantially constant, direct, positive voltage $V_3$ from a power supply (not shown) and a resistor 50 which is connected between the second input terminal 48 and the second output terminal 22.

Each indicator lamp driver 12 includes a relay 52 having an operating coil 54 for opening or closing a switch 56 disposed between a power supply terminal 58 which is connected to a lamp power source $V_L$ (not shown) and an output terminal 60, to thus energize or deenergize the indicating lamp 14 connected between the output terminal 60 and ground. One side of the relay operating coil 54 is connected to a power supply terminal 62, which is connected to receive a substantially constant direct voltage $V_4$ from the direct voltage power supply (not shown). The other side of the operating coil 54 is connected to the collector of a transistor 64, having an emitter connected to ground and a base connected to the input terminal 24 of the indicator lamp driver 12 by a resistor 66.

The signal scanning system shown in FIG. 1 also includes an alarm lamp driver 68 which is similar to the indicator lamp driver 12 and which is actuated by an alarm detector circuit 70 to energize an alarm indicator lamp 72 whenever the maximum signal of the three system input signals $V_a$, $V_b$, and $V_c$, exceeds a predetermined, positive polarity, reference voltage $V_R$.

The alarm detector circuit 70 includes an operational amplifier 74 having an output 76, a non-inverting input 78, an inverting input 80, and positive and negative operating power terminals 82 and 84 which may be connected to the same operating power source as the operational amplifier 26 to receive the positive and negative supply voltages $V_1$ and $V_2$. The non-inverting input 78 is connected through a first input resistor 86 and a first input terminal 87 to the scan bus 20. The inverting input 80 is connected to receive the positive voltage $V_R$ from a second input terminal 89 through a second input resistor 88, and is also connected to ground through a resistor 90. The operational amplifier output 76 is connected through a resistor 92 to an input terminal of the alarm lamp driver 68 corresponding to the input terminal 24 of the indicator lamp driver 12. A feedback resistor 94 is connected between the operational amplifier output 72 and the non-inverting input 78.

The signal scanning system of FIG. 1 also includes a load resistor 96 which is connected between the scan bus 20 and ground.

Typical values for the various resistors and voltage sources of the signal scanning system of FIG. 1 are given hereinafter solely for the purpose of best describing the operation of this system, and not by way of limitation. In a typical application, the signal scanning system of FIG. 1 may be used as the temperature scanning system of an aircraft, in which each temperature signal $V_a$, $V_b$, or $V_c$ varies proportional to the temperature of the element being sensed between a minimum, positive polarity, direct voltage signal of approximately +2.4 volts corresponding to the lowest operating temperature of the element and a maximum, positive polarity, direct voltage signal of approximately +5.35 volts corresponding to the maximum allowable operating temperature of the element. The operational amplifier input resistors 38, 40, and the transistor base resistor 66 each have a resistance of approximately 1 Kohms. The resistors 50 and 44 connected between the voltage supply terminal 48 and the operational amplifier output 28 have resistances of 3 Kohms and 2 Kohms, respectively. The feedback resistor 46 of the operational amplifier 26 has an resistance of approximately 4.7 M ohms. The resistor 96 connected between the scan bus 20 and ground has resistance of 10 Kohms. The operating power voltages $V_1$ and $V_2$ for the operational amplifiers 26, 74 are +15 volts and −15 volts, respectively. The voltage $V_3$ supplied to the second input terminal 48 of the priority detector circuit 10 is approximately +15 volts, and the voltage $V_4$ supplied to the relay operating coil 54 is approximately +6 volts.

Assuming the sensor direct voltage signal $V_a$ is the maximum signal of the three positive sensor signals, $V_a$, $V_b$, $V_c$, the voltage at the operational amplifier output 28 will be maintained at a positive voltage higher than the positive sensor signal $V_a$ to forward bias the diode 42 and allow sufficient current to flow through the scan bus grounding resistor 96 to ground to maintain the voltage $V_B$ of the scan bus 20 equal to the sensor signal $V_a$. Since the sensor signals $V_a$, $V_b$, $V_c$ each have a minimum value of +2.4 volts, the voltage at the operational amplifier output 28 must be a positive voltage in excess of +2.4 volts plus the forward voltage drop through the diode 42. Assuming a minimum drop of 0.6 volts through the diode 42, the voltage of the operational amplifier 28 must be at least +3.0 volts. The voltage appearing at the second output 22 of the priority detector circuit 10 which is connected through the 3,000 ohm resistor 50 to the voltage supply terminal 48 (+15 volts) and is connected through the 2,000 ohm resistor 44 to the operational amplifier output 28, will be a positive voltage higher than +10 volts. The transistor 64 of the indicator lamp driver 12, whose base is connected to receive the voltage appearing at the second output terminal 22 of the priority detection circuit 10 through the 1,000 ohm limiting resistor 66, will be in its conductive state. The relay 52 is energized by a transistor 64 to energize the indicator lamp 14 from a lamp voltage source $V_L$ which may be either a direct or alternating voltage source.

So long as the sensor voltage $V_a$ is the maximum, or most positive, direct voltage signal of signals $V_a$, $V_b$, $V_c$, the diode 42 of the other priority detector circuits 10', 10'' will be reversed-biased, the voltage appearing at the operational amplifier outputs 28 of the priority detector circuit 10', 10'' will be a negative voltage of approximately −15 volts, and the indicator lamp drivers 12', 12'' and associated indicator lamps 14', 14'' will be deenergized. If then, the sensor signal $V_b$ becomes more positive than the sensor signal $V_a$, the operational amplifier output 28 of the priority detector circuit 10' will be abruptly switched to a positive voltage, to render conductive the diode 42 connected thereto and allow sufficient current to flow through the load resistor 96 so that the scan bus voltage $V_B$ appearing across the load resistor 96 essentially equals the sensor signal $V_b$. When this occurs, the voltage appearing at the inverting input 32 of the operational amplifier 26 of the priority detector circuit 10 becomes more positive than the voltage appearing at the non-inverting input 30 of this operational amplifier 26, which causes the operational amplifier output 28 to be abruptly switched to a negative voltage, which in turn, reverse-biases the diode 42 and switches the transistor 64 of the indicator lamp driver 12 to its non-conducting state. Since the resistance of the by-pass resistor 46 is several orders of magnitude higher than that of the amplifier input resistor 38, the gain of the operational amplifier 26 is very high so that the operational amplifier output 28 is very abruptly switched from a positive value of at least +3.0 volts to a negative value of approximately −15 volts. The voltage at the second output 22 of the priority detector circuit 10 will also be very abruptly switched from a positive value greater than +10 volts to a negative value of approximately −3 volts, to abruptly switch the transistor 64 of the indicator lamp driver 12 from its conducting state into its non-conducting state to quickly deenergize the relay 52. When the relay 52 is deenergized, the switch 56 is opened to deenergize the indicator lamp 14.

If, thereafter, the direct voltage signal $V_a$ becomes more positive than either of the other sensor signals, $V_b$, $V_c$, the voltage appearing at the non-inverting input 30 of the operational amplifier 26 of the priority detector circuit 10 becomes more positive than the voltage appearing at the inverting input 32, which causes the operational amplifier output 28 of the priority detector circuit 10 to be very abruptly switched from a negative value of approximately −15 volts to a positive value higher than the voltage $V_B$ of the scan bus 20. In turn, this causes the diode 42 of the priority detector circuit 10 to again be forward-biased and the transistor 64 of the indicator lamp driver 12 to be abruptly switched to its conducting state to energize the associated relay the three sensor 54 and the indicating lamp 14.

So long as the maximum signal of the three sensor signals $V_a$, $V_b$, $V_c$ does not exceed its maximum operating voltage of +5.35 volts, the voltage appearing at the inverting input 80 of the operational amplifier 74 of the alarm detector circuit 70 will be greater than the voltage appearing at the non-inverting input 78 of the same operational amplifier 74, so that the voltage appearing at the operational amplifier output 76 will be a negative voltage which is supplied to the alarm lamp driver 68 to maintain the alarm indicator lamp 72 deenergized. When the maximum signal of the three positive sensor signals $V_a$, $V_b$, $V_c$ exceeds its maximum operating voltage of +5.35 volts, thus indicating an abnormally high temperature or the like, the voltage appearing at the non-inverting input 78 of the operational amplifier 74 becomes more positive than the voltage appearing at the inverting input 78 of the operational amplifier 74, which causes the voltage appearing at the operational amplifier output 76 to be abruptly switched to a positive voltage value, which in turn, actuates the alarm lamp driver 68 to energize the alarm indicator lamp 72. When the alarm indicator lamp 72 is energized, the indicator lamp 14, 14' or 14'' associated with the priority detector circuit 10, 10' or 10'' receiving the maximum signal of the 3 sensor signals $V_a$, $V_b$, $V_c$ remains energized to identify the abnormally high sensor signal.

If one of the priority detector circuits 10, 10' or 10'' fails to receive a positive polarity sensor signal, $V_a$, $V_b$ or $V_c$, caused, for example, by a malfunction in the sensor signal generating or processing apparatus or by an open circuit in the connecting lines supplying this sensor signal to the priority detector circuit, both the indicator lamp 14, 14' or 14'' associated with this priority detector circuit and the alarm indicator lamp 72 will be energized. For example, assuming that the sensor signal $V_b$ is the highest of the three positive sensor signals $V_a$, $V_b$, and $V_c$, the operational amplifier output 28 of the priority detector circuit 10 is maintained at a negative polarity voltage of approximately −15 volts, to reverse-bias the diode 42 connected thereto. Then if the sensor signal line for supplying the sensor signal $V_a$ is disconnected from the priority detector circuit input 16 of the priority detector circuit 10, the voltage at the operational amplifier output 28 of the priority detector circuit 10 will abruptly rise to a value determined by the resistance values of the various elements forming a current path (including the operational amplifier output 28) between the power supply terminal 48, which is maintained at a positive polarity voltage $V_3$ of approximately +15 volts, and ground. Neglecting the high resistance of the path to ground through the input resistor 86 and the operational amplifier 74 of the alarm detector circuit 70, the voltage at the output 28 of the operational amplifier 26 of the priority circuit 10 will be determined by the resistances, 2K and 3 Kohms, of the resistor 44 and the resistor 50, which are connected in series between the operational amplifier output 28 and the power supply terminal 48 of priority detector circuit 10, and by the forward voltage drop of the diode 42 of the priority detector circuit 10 and the 10 Kohm resistance of the load resistor 96, which are connected into series between the operational amplifier output 28 and ground. Assuming the forward voltage drop through the diode 42 is approximately 0.6 volts, when no sensor signal $V_a$ is supplied to the priority detector circuit 10, the voltage at the operational amplifier output 28 of the priority detector circuit 10 will rise to approximately +10.2 volts, during which the diode 42 connected thereto will become forward-biased. The voltage at the second output terminal 22 of the priority detector circuit 10 will rise to approximately +12.1 volts, switching the indicator lamp driver 12 to energize the indicator lamp 14, and the scan bus voltage $V_B$ will rise to approximately +9.6 volts, which causes the alarm detector circuit 70 to actuate the alarm lamp driver 68 and energize the alarm indicator lamp 72.

Figure 2:
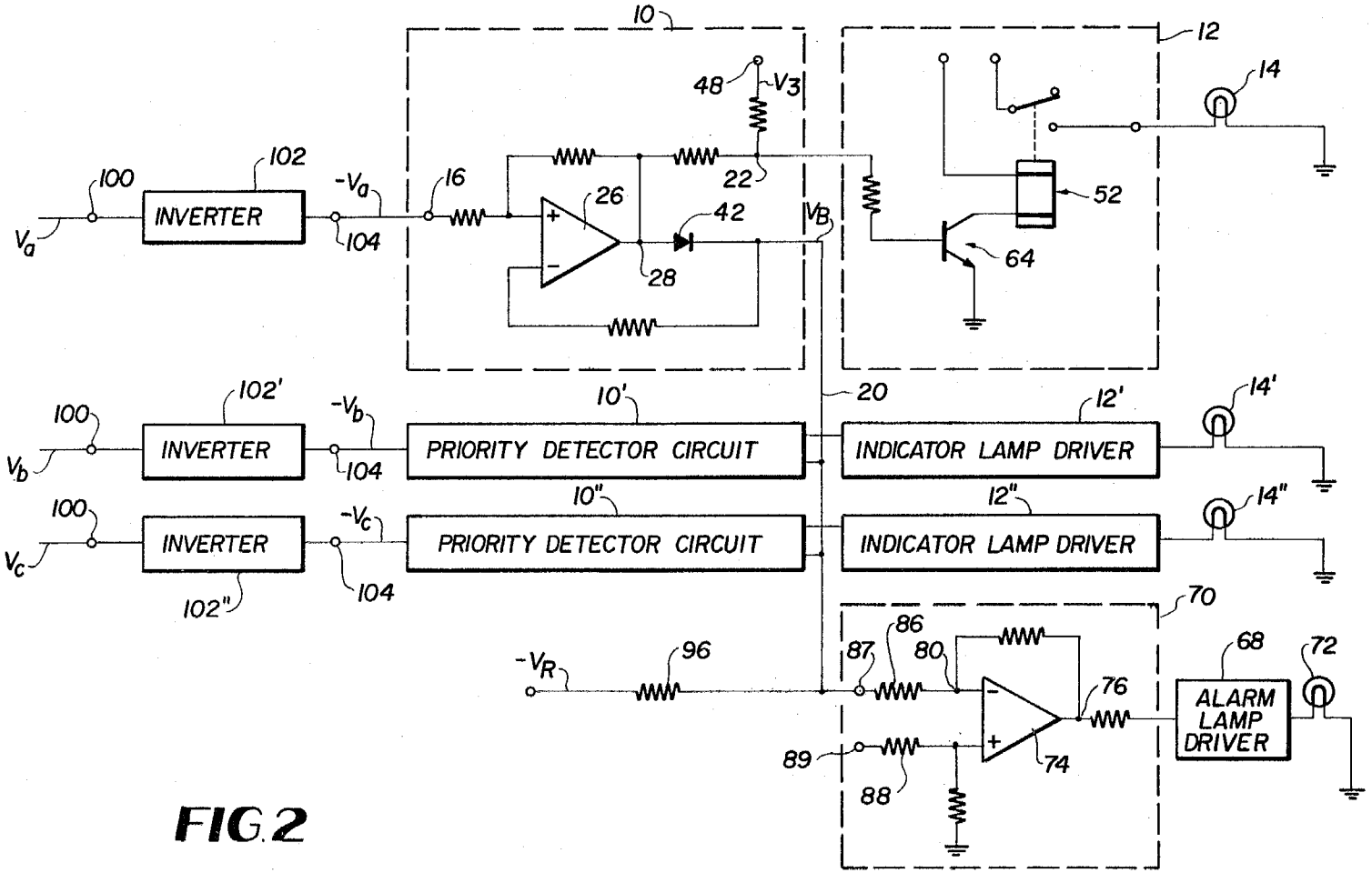
FIG. 2 is an electrical schematic diagram, partially in block form, of a variation of the embodiment of FIG. 1, for detecting the minimum signal of the plurality of direct voltage signals.

The automatic signal scanning system of FIG. 1 may be modified as shown in FIG. 2 to determine the minimum signal of the three positive polarity direct voltage signals $V_a$, $V_b$, and $V_c$. In the automatic signal scanning system of FIG. 2, the three positive polarity direct voltage signals $V_a$, $V_b$, $V_c$ are supplied to inputs 100 of three conventional signal inverters 102, 102', 102'', respectively. The outputs 104 of the inverters 102, 102', 102'' are connected to the inputs 16 of the priority detector circuits 10, 10' and 10'', respectively, to supply thereto inverted voltage sensor signals $-V_a$, $-V_b$, $-V_c$ of negative polarity Assuming the same operating voltage range of the positive polarity, direct voltage sensor signals $V_a$, $V_b$ and $V_c$ as stated above, the inverted sensor signals $-V_a$, $-V_b$, $-V_c$ will vary between a minimum operating voltage of −5.35 volts corresponding to the maximum operating voltage of +5.35 volts of the non-inverted sensor signals $V_a$, $V_b$, and $V_c$, and a maximum operating voltage of −2.4 volts corresponding to the minimum operating voltage of +2.4 volts of the non-inverted sensor signals $V_a$, $V_b$ and $V_c$.

In the system of FIG. 2, the resistor 96 is connected between the scan plus 20 and a negative polarity reference voltage source $-V_R$ which is less, i.e., more negative, than the minimum operating voltage of the inverted sensor signals $-V_a$, $-V_b$, $-V_c$, for example, −5.5 volts. Also, in the system of FIG. 2, the connections to the inputs of the operational amplifier 74 of the alarm detector circuit 70 are reversed from those shown in the system of FIG. 1, so that the inverting input 80 of the operational amplifier 74 is connected through the resistor 86 and the first input terminal 87 to the scan bus 20 and the non-inverting input 78 of the operational amplifier 74 is connected so that this non-inverting input 78 is maintained at a higher voltage than the maximum operating voltage of the inverted sensor signals $-V_a$, $-V_b$ and $-V_c$. For example, the second input terminal 89 may be connected to a reference voltage to maintain the voltage at the non-inverting input 78 at a level of approximately −2.3 volts, which is higher than the maximum operating voltage of −2.4 volts of the inverted sensor signals $-V_a$, $-V_b$, $-V_c$. The remainder of the circuitry of the signal scanning system shown in FIG. 2 is identical to that of the system shown in FIG. 1.

Assuming that the positive polarity sensor signal $V_a$ is the minimum signal of the three sensor signals $V_a$, $V_b$, and $V_c$, the inverted sensor signal $-V_a$ will be the maximum signal of the three inverted sensor signals $-V_a$, $-V_b$, $-V_c$, supplied to the priority detector circuits 10, 10', 10''. The voltage at the operational amplifier output 28 of the priority detector circuit 10 will be maintained at a higher voltage, i.e., a more positive voltage, than the inverted sensor signal $-V_a$ to forward bias the diode 42 and allow sufficient current to flow through the load resistor 96 to the negative reference voltage $-V_R$ to maintain the voltage $V_B$ of the scan bus 20 equal to the inverted sensor signal $-V_a$. Assuming a minimum forward voltage drop of 0.6 volts through the diode 42 of the priority detector circuit 10, the scan bus voltage $V_B$ must be higher than −5.35 volts, the voltage at the operational amplifier output 28 of the priority detect or circuit 10 must be higher than −4.75 volts, and the voltage at the second output 22 of the priority detector circuit 10 must be at least +2.5 volts, which is sufficient to render the transistor 64 of the indicator lamp driver 12 conductive, activating the associated relay 52 to energize the indicator lamp 14.

If, thereafter, the sensor signal $V_b$ becomes the minimum sensor signal, the voltage at the operational amplifier output 28 of the priority detector circuit 10' will be abruptly switched from a value of approximately −15 volts to a value higher than −4.75 volts, to render its associated diode 42 conductive and allow sufficient current to flow through the load resistor 96 to maintain the voltage $V_B$ of the scan bus 20 equal to the inverted sensor signal $-V_b$. The voltage at the second output terminal 22 of the priority detector circuit 10' will likewise be abruptly switched to a positive value sufficient to actuate the indicator lamp driver 12' and energize the indicator light 14'.

When the diode 42 of the priority detector circuit 10' starts to conduct, the voltage at the operational amplifier output 28 of the priority detector circuit 10 will be abruptly switched to a value of approximately −15 volts to reverse-bias the diode 42 of the priority circuit 10. The voltage at the second output terminal 22 of the priority detector circuit 10 will be abruptly switched from a positive voltage of at least +2.5 volts to a negative voltage of approximately −3 volts, rendering the transistor 64 non-conductive and deenergizing the relay 52 of the indicator lamp driver 12, to thus deenergize the indicator lamp 14.

When the minimum signal of the three sensor signals $V_a$, $V_b$, $V_c$ falls below +2.25 volts, or when any one of the connecting lines supplying these sensor signals $V_a$, $V_b$, $V_c$ to the inverters 102, 102', 102'' is grounded, the voltage at the operational amplifier outputs 76 of the alarm detector circuit 70 is abruptly switched from a negative polarity voltage to a positive polarity voltage to activate the alarm lamp driver 68 and energize the alarm indicating lamp 72.

When no sensor signal is supplied to one of the inverters 102, 102', 102'' or when one of the lines between the inverters 102, 102'', 102'' and the priority detector circuits 10, 10', 10'' is opened, both the indicator lamp 14, 14' or 14'' for the affected priority detector circuit 10, 10' or 10'' and the alarm indicator lamp 72 are energized, in the same manner as described above for the signal scanning system of FIG. 1. For example, if the line supplying the sensor signal $V_a$ to the inverter 102 is opened, no inverted sensor signal $-V_a$ will be supplied to the input 16 of the priority detector circuit 10. The voltage at the operational amplifier output 28 of the priority detector circuit 10 will abruptly rise to a value of approximately +8.4 volts, forward-biasing the diode 42 and raising the scan bus voltage $V_B$ to a positive voltage of approximately +8.4 volts, which causes the alarm detector circuit 70 to activate the alarm lamp driver 68 and energize the alarm indicator lamp 72. The voltage to the second output terminal 22 of the priority detector circuit 10 will also abruptly rise to a positive value of approximately +11 volts, activating the indicator lamp driver 12 and energizing the indicator lamp 14.

Thus, in the automatic signal scanning system of FIG. 2, only one of the indicating lamps 14, 14', 14'' is energized at any time. When the alarm indicating lamp 72 is also energized, the energized indicating lamp 14, 14', or 14'' identifies the inverter circuit 102, 102', or 102'' receiving an abnormally low positive polarity sensor signal or receiving no sensor signal, as would occur, for example, when the line supplying the sensor signal to the inverter is either opened or grounded. Also, when the alarm indicator lamp 72 is energized, the energized indicator lamp 14, 14' or 14'' may indicate the priority detector circuit 10, 10' or 10'' having an input terminal 16 which is either grounded or which is receiving no inverted sensor signal from its associated inverter 102, 102' or 102''. When the alarm indicator lamp 72 is not energized, the energized indicator lamp 14, 14' or 14'' indicates the inverter 102, 102' or 102'' receiving the minimum signal of the three positive polarity sensor signals $V_a$, $V_b$, and $V_c$.

In the automatic signal scanning system of FIG. 1, the energization of the alarm indicator lamp 72, together with one of the indicator lamps 14, 14' or 14'', indicates the priority detector circuit 10, 10' or 10'' which either is receiving an abnormall high sensor signal $V_a$, $V_b$ or $V_c$, or is not receiving any sensor signal. Thus, when the signal scanning systems of FIG. 1 and FIG. 2 are used to indicate both the highest and the lowest signal of a plurality of positive polarity sensor signals, with each sensor signal input line being connected to both a priority detector circuit input 16 of the system of FIG. 1, and to an inverter input 100 of the system of FIG. 2, the simultaneous energization of the two alarm indicator lamps 72 and the two indicator lamps 14, 14' or 14'' associated with the same sensor signal $V_a$, $V_b$ or $V_c$ identifies a disconnected or open circuited sensor signal input line.

Figure 3:
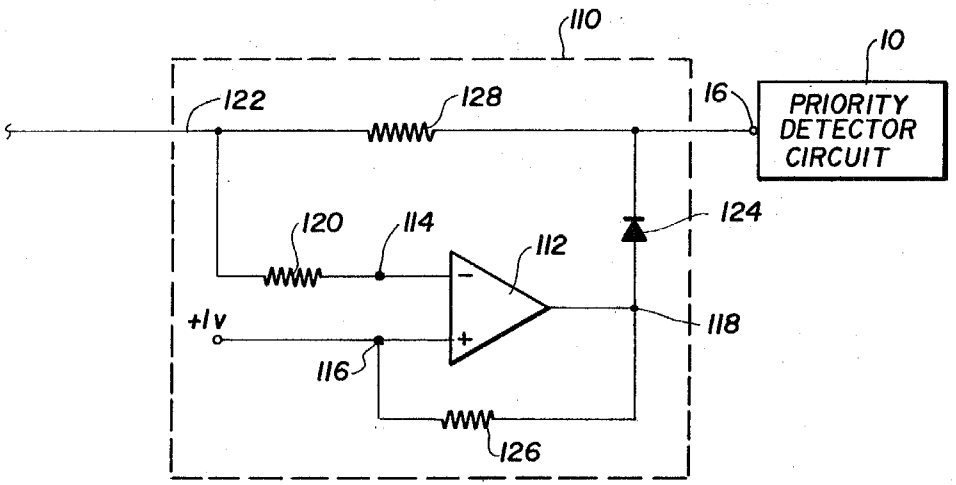
FIG. 3 is an electrical schematic diagram, partially in block form, showing additional elements and circuitry which may be used with the system of FIG. 1 to indicate a grounded line for supplying one of the signals to the system of FIG. 1.

If only the automatic signal scanning system of FIG. 1 is used, and it is desired or required that one of the indicator lamps 14, 14', 14'' and the alarm indicator lamp 72 be energized to indicate and identify a grounded priority detector circuit input terminal 16, signal conditioners 110 for providing such indication may be disposed between the sensor signal incoming lines and the priority detector circuit input terminals 16, respectively, as shown in FIG. 3. Each signal conditioner 110 includes an operational amplifier 112 having an inverting input 114, a non-inverting input 116, and an output 118. The inverting input 114 is connected through an input resistor 120 to a sensor signal incoming line 122 to receive one of the positive polarity sensor signals $V_a$, $V_b$ or $V_c$. The non-inverting input 116 is connected to receive a positive polarity, constant reference voltage less the minimum operating voltage of the positive sensor signal, for example, +1 volt, from a power supply (not shown). The operational amplifier output 118 is connected through a diode 124 to the input terminal 16 of one of the priority detector circuits 10, 10', 10''. A feedback resistor 126, having a very high ohmic value, typically, 4.7 Mohms, is connected between the operational amplifier output 118 and the non-inverting input 116. Also, the sensor signal incoming line 122 is connected to the priority detector circuit incoming terminal 16 through a resistor 128, typically having a resistance of approximately 1 Kohms.

So long as the positive polarity sensor signal $V_a$, $V_b$, or $V_c$ is greater than +1 volt, the output signal of the operational amplifier 112 is a negative polarity signal, the diode 124 is reversed-biased, and the sensor signal $V_a$, $V_b$, or $V_c$ is supplied to the priority detector circuit input terminal 16 through the resistor 128. When the sensor signal incoming line 122 becomes grounded, the operational amplifier output 118 is abruptly switched to its maximum positive output voltage forward-biasing the diode 124 and allowing sufficient current flow through the resistor 128 to supply a positive polarity voltage signal to the priority detector circuit input terminal 16 greater than the normal maximum operating voltage of the positive polarity sensor signal $V_a$, $V_b$, or $V_c$. This, in turn, causes both the indicator lamp 14, 14' or 14'' associated with this input circuit and the alarm indicator lamp 72 to be energized, as explained above in connection with the signal scanning system of FIG. 1.

Figure 4:
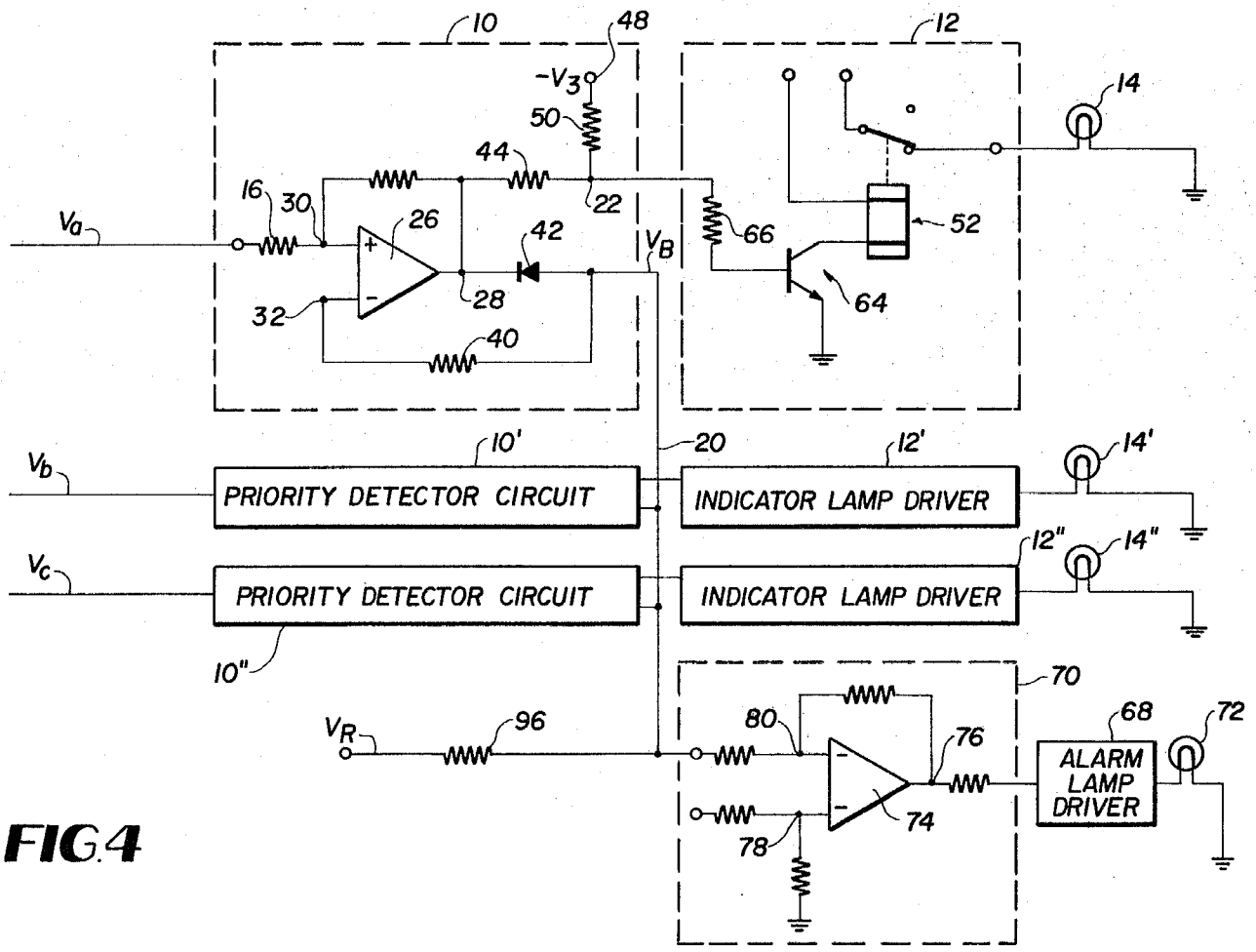
FIG. 4 is an electrical schematic diagram, partially in block form, of another embodiment of the invention for detecting the minimum signal of a plurality of direct voltage signals.

FIG. 4 shows another embodiment of the invention, in which the automatic signal scanning system of FIG. 1 is modified to indicate the lowest signal of a plurality of positive polarity sensor signals $V_a$, $V_b$, $V_c$ by reversing the connections of each priority detector circuit diode 42, connecting each second input terminal 48 of the priority detector circuits to receive a negative polarity reference signal $-V_3$ of approximately −15 volts, and connecting the load resistor 96 between the scan bus 20 and a positive reference voltage source $V_R$ of approximately +5.5 volts. Also, each indicating lamp 14, 14', 14" is connected to be energized through a normally closed contact of the relay 52, rather than a normally open contact as shown in FIG. 1, and each alarm detection circuit 70 is connected as shown in FIG. 2.

In the automatic signal scanning system of FIG. 4, the scan bus voltage $V_B$ is maintained essentially equal to the minimum signal of the three positive polarity sensor signals $V_a$, $V_b$, $V_c$. For example, assuming a minimum forward voltage drop of 0.6 volts through the diode 42, when the sensor signal $V_a$ is the minimum signal of the three positive polarity sensor signals $V_a$, $V_b$, $V_c$, the operational amplifier output 28 of the priority detector circuit 10 will be maintained at a voltage which is of negative polarity relative to the scan bus voltage $V_B$ supplied to the operational amplifier inverting input 32 through the feedback resistor 40, to forward-bias the diode 42 of the priority detector circuit 10 and allow sufficient current to flow through the load resistor 96 and this diode 42 to maintain the scan bus voltage $V_B$ essentially equal to the sensor signal $V_a$. Thus, the scan voltage $V_B$ will be a positive polarity voltage within the range of +2.4 volts to +5.35 volts. The voltage at the operational amplifier output 28 will be a positive voltage in the range of +1.8 volts to +4.75 volts. The voltage at the second output terminal 22 of the priority detector circuit 10 will be a negative voltage in the range of −5 to −3 volts, which is sufficient to maintain the transistor 64 of the indicator lamp driver 12 in its non-conducting state. The relay 52 of the indicator lamp driver 12 will be deenergized, and the indicator lamp 14 will be energized.

If one of the other sensor signals $V_b$ or $V_c$ then becomes the minimum sensor signal, the signal $V_a$ at the operational amplifier non-inverting input 30 of the priority detector circuit 10 becomes positive with respect to the scan bus voltage $V_B$ at the operational amplifier inverting input 32, which causes the operational amplifier output 28 to be abruptly switched to a maximum positive polarity voltage of approximately +15 volts, thus reverse-biasing the diode 42 of the priority detector circuit 10 and rendering it non-conductive. The voltage at the second output terminal 22 of the priority detector circuit 10 is similarly abruptly switched from a negative polarity voltage in the range of −3 to −5 volts to a positive polarity voltage of approximately +3 volts, to switch the transistor 64 of the indicator lamp driver 12 to its conducting state, thus energizing the relay 52 of the indicator lamp driver 12 and deenergizing the indicator lamp 14.

If the minimum signal of the three positive polarity sensor signals $V_a$, $V_b$, $V_c$ falls below its normal minimum operating voltage of +2.4 volts, the alarm detector circuit 70 will actuate the alarm lamp driver 68 to energize the alarm indicator lamp 72.

Similarly, if one of the priority detector circuit first input terminals 16 becomes grounded, the scan bus voltage $V_B$ will be reduced to approximately ground potential and both the alarm indicator lamp 72 and the indicator lamp 14, 14' or 14" associated with the grounded input terminal 16 will be energized.

When no sensor signal is received at the first input terminal 16 of one of the priority detector circuits 10, 10' or 10", in the signal scanning system of FIG. 4, the scan bus voltage $V_B$ and the voltage at the second output 22 of this priority detector circuit will be determined by the diode 42 and the resistors 96, 44 and 50, which are connected in series between the positive voltage source $V_R$ of +5.5 volts and the negative voltage source $-V_3$ of −15 volts. The scan bus voltage $V_B$ will decrease to approximately −1.1 volts, which causes the alarm detector circuit 70 to actuate the alarm lamp driver 68 and energize the alarm indicator lamp 72. The voltage at the second output 22 of the affected priority detector circuit 10, 10', 10" will decrease to a value of approximately −11 volts, to render the transistor 64 of the associated indicator lamp driver 12, 12' or 12" non-conductive, thus deenergizing the relay 52 of this indicator lamp driver 12, 12' or 12" and energizing the associated indicator lamp 14, 14' or 14".

The automatic signal scanning system of FIG. 2 may be similarly modified to indicate the minimum signal of the inverted, negative polarity, sensor signals $-V_a$, $-V_b$, $-V_c$, by modifying the priority detector circuits 10, 10', 10" and the indicator lamp drivers 12, 12', 12" in the same manner as described above for the system of FIG. 4, connecting the scan bus 20 to ground through the resistor 96, and supplying a reference voltage to the operational amplifier non-inverting input 78 of the alarm detector circuit 70 which does not exceed −5.35 volts.

Figure 5:
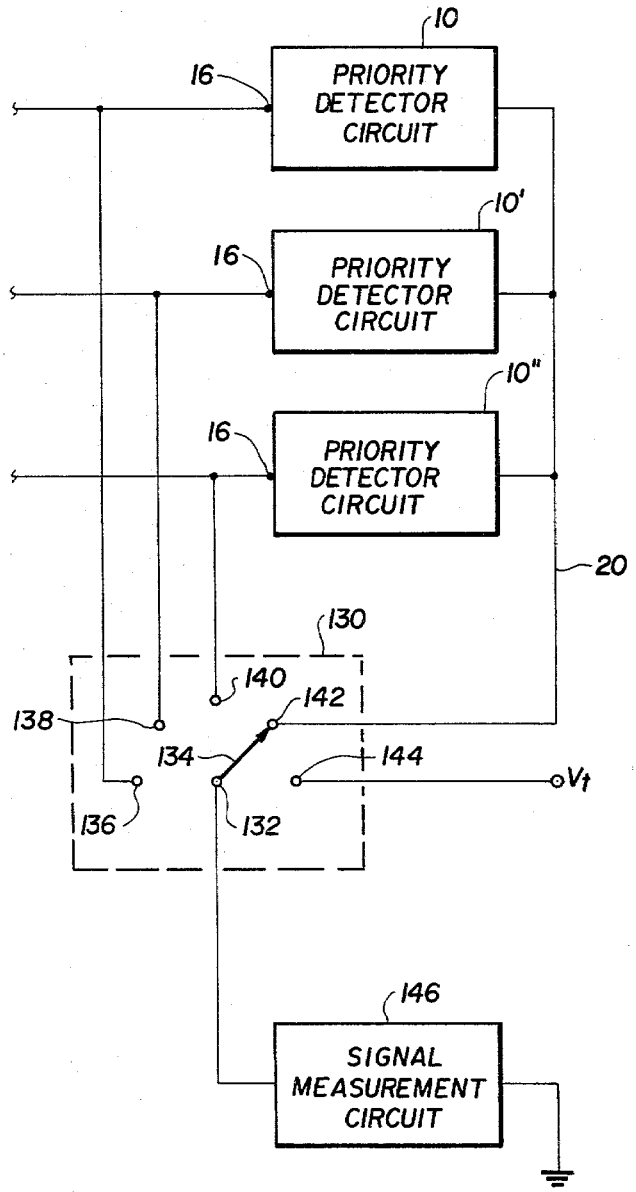
FIG. 5 is an electrical schematic diagram, partially in block form, of an signal switching and measuring circuit which may be used with the embodiments of FIGS. 1, 2 and 4.

The signal switching and measuring circuit shown in FIG. 5 may be used with any of the automatic signal scanning systems discussed above. A selector switch 130 has an output terminal 132 which is selectively connected by a rotatable arm 134 to any of five input terminals 136, 138, 140, 142, and 144. The input terminals 136, 138, 140 are connected to the first input terminals 16 of the priority detector circuits 10, 10', 10", respectively. The input terminal 142 is connected to the scan bus 20. The input 144 is connected to receive a constant direct voltage test signal $V_t$. When the movable arm 134 is moved to its test position at which it connects the input terminal 144 to the output terminal 132, the test signal $V_t$ is supplied to a signal measurement circuit 146 to check the operation and calibration of this measurement circuit 146.

The signal switching and measuring circuit of FIG. 5 may be used with the signal scanning system of FIG. 1 to measure any of the three positive polarity sensor signals $V_a$, $V_b$, or $V_c$ or to measure the scan bus voltage $V_B$ which, in this embodiment of the invention, is essentially equal to the maximum signal of the three positive polarity sensor signals $V_a$, $V_b$, and $V_c$.

The signal switching and measuring circuit of FIG. 5 may be used with the signal scanning system of FIG. 2 to measure any of the three negative polarity, inverted sensor signals $-V_a$, $-V_b$, and $-V_c$, or to measure the scan bus voltage $V_B$, which, in this embodiment, is essentially equal to the maximum signal of the three inverted sensor signals $-V_a$, $-V_b$, and $-V_c$, which is of equal magnitude, but opposite polarity as the minimum signal of the three positive polarity sensor signals, $V_a$, $V_b$, and $V_c$.

The signal switching and measuring circuit of FIG. 5 may be used with the signal scanning system of FIG. 4 to measure any of the three positive polarity, sensor signals $V_a$, $V_b$ and $V_c$, or to measure the scan bus voltage $V_B$, which, in this embodiment invention, is essentially equal to the minimum signal of the three positive plurality sensor signals $V_a$, $V_b$, and $V_c$.

The foregoing relates to preferred exemplary embodiments of the invention, it being understood that other embodiments and variations thereof are possible within the spirit and scope of the invention, the latter being defined by the appended claims.

What is claimed and desired to be secured by Letters Patent of the United States is:

1. A signal selection circuit, including a scan bus, for normally maintaining the scan bus at essentially the same voltage as one of two limiting signals of a plurality of first direct voltage signals which are normally variable within an operating voltage range between a maximum operating voltage and a minimum operating voltage, the two limiting signals being a maximum, i.e., most positive, signal of the plurality of first signals and a minimum, i.e., most negative, signal of the plurality of first signals, the signal selection circuit comprising:

a first direct voltage source for providing a first constant reference voltage disposed outside the normal operating voltage range of the plurality of first signals and displaced from the one limiting signal in the same direction as the other limiting signal is displaced from the one limiting signal;

a load resistor, connected between the first voltage source and the scan bus;

a plurality of operational amplifiers, each having an output, a non-inverting input, and an inverting input, wherein the amplifier non-inverting inputs are respectively connected to receive said first signals, and the amplifier inverting inputs are connected to the scan bus;

a plurality of diodes, respectively connected between the amplifier outputs and the scan bus, so that each diode, when forward-biased, allows current to flow between the amplifier output connected to the diode and the first voltage source in one direction through the load resistor, the scan bus and the diode, to maintain the scan bus voltage at essentially the same voltage as the first signal applied to the non-inverting input of the operational amplifier connected to the diode, each diode being disposed so that it is forward-biased by an amplifier output voltage generated by the operational amplifier connected to the diode whenever the first signal at the amplifier non-inverting input is the one limiting signal.

2. A signal selection circuit, as described in claim 1, wherein:

the one limiting signal is the maximum signal of the plurality of first signals;

the first reference voltage is a constant direct voltage which is less than the minimum operating voltage of the first signals; and each diode has a cathode connected to the scan bus and an anode connected to the output of the operational amplifier associated with the diode.

3. A signal selection circuit, as described in claim 1, wherein:

the one limiting signal is the minimum signal of the plurality of first signals;

the first reference voltage is a constant direct voltage which is greater than the maximum operating voltage of the first signals; and each diode has an anode connected to the scan bus and a cathode connected to the output of the operational amplifier associated with the diode.

4. A signal selection circuit, as described in claim 1, which further comprises signal indicating means for identifying the one limiting signal of said plurality of first signals.

5. A signal selection circuit, as described in claim 1, which further comprises voltage measuring means and selector switch means for selectively connecting the voltage measuring means to measure the scan bus voltage or the voltage of any first signal of the plurality of first signals.

6. A signal selection circuit, as described in claim 1, which further comprises alarm means for providing indication whenever said one limiting signal is outside the normal voltage operating voltage range of said first signals.

7. A signal selection circuit, as described in claim 1, which further comprises alarm means for providing indication whenever the other limiting signal of said two limiting signals is outside the normal voltage operating range of said first signals.

8. A signal selection circuit, as described in claim 1, which further comprises a plurality of signal inverter circuits, having inputs respectively connected to receive a plurality of second direct voltage signals which are respectively of equal magnitude and of opposite polarity as said first signals, and having outputs respectively connected to the non-inverting inputs of the operational amplifiers.

9. A signal selection circuit, including a scan bus, for normally maintaining the scan bus at essentially the same voltage as one of two limiting signals of a plurality of first direct voltage signals which are normally variable within an operating voltage range between a maximum operating voltage and a minimum operating voltage, the two limiting signals being a maximum, i.e., most positive, signal of the plurality of first signals and a minimum, i.e., most negative, signal of the plurality of first signals, the signal selection circuit comprising:

a first direct voltage source for providing a first constant reference voltage disposed outside the operating voltage range of said first signals and displaced from the one limiting signal in the same direction as the other limiting signal is displaced from the one limiting signal;

a second direct voltage source for providing a second constant reference voltage disposed outside the operating voltage range of said first signals such that the operating voltage range of said first signals is disposed between said first and second reference voltages;

alarm indicating means for providing indication whenever the scan bus voltage is disposed between the operating voltage range of said first signals and the second reference voltage;

a load resistor connected between the first voltage source and the scan bus;

a plurality of detector circuits having first inputs respectively connected to receive said first signals, second inputs connected to receive said second reference voltage, and first outputs connected to scan bus, wherein each detector circuit includes an operational amplifier with high voltage gain, having an output, a non-inverting input connected to the detector circuit first input to receive one of said first signals, and an inverting input connected to the detector circuit first output to receive the scan bus voltage, a diode, connected between the amplifier output and the detector circuit first output to allow current to flow therethrough in one direction so that, when the first signal being received at the amplifier non-inverting input becomes said one limiting signal, the amplifier output voltage is abruptly switched to a voltage which forward-biases the diode and allows sufficient current flow through the load resistor to maintain the scan bus voltage at the amplifier inverting input essentially equal to the one limiting signal at the amplifier non-inverting input, a first resistor connected between the amplifier output and the detector circuit second input receiving the second reference voltage, for forward-biasing the diode in the absence of an amplifier output voltage and allowing sufficient current flow through the load resistor to maintain the scan bus voltage at a voltage intermediate the operating voltage range of said first signals and the second reference voltage;

whereby the alarm indicating means provides indication that the one limiting signal of said first signals is an abnormal signal disposed outside the normal operating voltage range of the first signals, or that no output voltage is being generated by one of the operational amplifiers of the detector circuits.

10. A signal selection circuit, as described in claim 9, which further comprises a plurality of indicating means, associated respectively with the detector circuit diode, for identifying any forward-bias diode of the detector circuit diodes.

11. A signal selector circuit, as described in claim 9, wherein:

each diode has a cathode connected to the detector circuit and an anode connected to the operational amplifier output associated with the diode, whereby the one limiting signal is the maximum signal of the plurality of first signals;

the minimum and maximum operating voltages defining the normal operating voltage range of the first signals are negative polarity voltages with respect to ground;

whereby the alarm indicating means further provides indication whenever one of the detector circuit first inputs is grounded.

12. A signal selector circuit, as described in claim 9, wherein:

each detector circuit diode has an anode connected to the detector first output and a cathode connected to the operational amplifier output associated with the diode, whereby one limiting signal is the minimum signal of the plurality of first signals;

the minimum and maximum operating voltages defining the normal operating voltage range of the first signals are polarity voltages with respect to ground;

whereby the alarm indicating means further provides indication whenever a detector circuit first input is grounded.

13. A signal selection circuit, as described in claim 9, wherein:

the maximum and minimum operating voltages of the first signals are voltages of the same polarity relative to ground; and the signal selection circuit further comprises a plurality of signal inverter circuits, having inputs respectively connected to receive a plurality of second direct voltage signals which are respectively of equal magnitude and of opposite polarity relative to ground as the plurality of first signals, and having outputs respectively connected to the detector circuit first inputs, wherein each second signal is inverted to form a corresponding first signal of the same magnitude and opposite polarity relative to ground.

* * * * *